US007347014B1

(12) United States Patent
Fiandach

(10) Patent No.: US 7,347,014 B1
(45) Date of Patent: Mar. 25, 2008

(54) SNOWPLOW IMPROVEMENT

(76) Inventor: Richard J. Fiandach, 639 Whitney Rd. West, Fairport, NY (US) 14450

( * ) Notice: Subject to any disclaimer, the term of this patent is extended or adjusted under 35 U.S.C. 154(b) by 363 days.

(21) Appl. No.: 11/064,507

(22) Filed: Feb. 24, 2005

Related U.S. Application Data

(60) Provisional application No. 60/548,133, filed on Feb. 27, 2004.

(51) Int. Cl.
*E02F 3/76* (2006.01)
*E01H 5/06* (2006.01)

(52) U.S. Cl. ..... 37/270; 37/281; 172/815

(58) Field of Classification Search ..... 37/281, 37/270; 172/815; 403/122
See application file for complete search history.

(56) References Cited

U.S. PATENT DOCUMENTS 4,384,620 A * 5/1983 Uchida et al. ..... 172/815

5,802,746 A * 9/1998 Miller ..... 37/263

* cited by examiner

*Primary Examiner*—Christopher J. Novosad
(74) *Attorney, Agent, or Firm*—Robert J. Bird

(57) ABSTRACT

A snowplow includes a blade and bottom plate with a mounting plate bolted to an end portion of the bottom plate. A channel bracket is fixed to the mounting plate with its flanges extending forward and its web thereby spaced forward of the mounting plate to form a pad plate. A resilient rubber pad, larger than the pad plate, is removably mounted on the pad plate to extend inward, outward, upward and downward from it. The rubber pad is invertible and reversible on the pad plate. The planes of the pad plate and of the rubber pad are skewed inward and downward relative to the plane of the mounting plate. The bottom plate includes spaced bolt holes for selective positioning of the mounting plate relative to the bottom plate for variable plow width.

3 Claims, 2 Drawing Sheets

SNOWPLOW IMPROVEMENT

CROSS-REFERENCE TO RELATED APPLICATION

This application relates to my copending Provisional Patent Application No. 60/548,133 which was filed on Feb. 27, 2004. That filing date is claimed for this application.

BACKGROUND OF THE INVENTION

This invention is an improvement of the type of snowplow which is typically mounted on the front of a pickup truck or the like.

A typical snowplow of the prior art has the ends of its blade exposed and susceptible to impact with curbs, storm drains, and other such interferences along the side of a road or driveway. Such impacts are damaging to the plow and to the object hit by it. They are also dangerous to the driver.

SUMMARY OF THE INVENTION

In summary, this invention is a snowplow, including blade and bottom plate, with a mounting plate bolted to an end portion of the bottom plate. A channel bracket is fixed to the mounting plate with its flanges extending forward and its web thereby spaced forward of the mounting plate to form a pad plate. A resilient rubber pad, larger than the pad plate, is removably mounted on the pad plate to extend inward, outward, upward and downward from it. The rubber pad is invertible and reversible on the pad plate. The planes of the pad plate and of the rubber pad are skewed inward and downward relative to the plane of the mounting plate. The bottom plate includes spaced bolt holes for selective positioning of the mounting plate relative to the bottom plate for variable plow width.

DRAWING

DESCRIPTION

Figure 1:
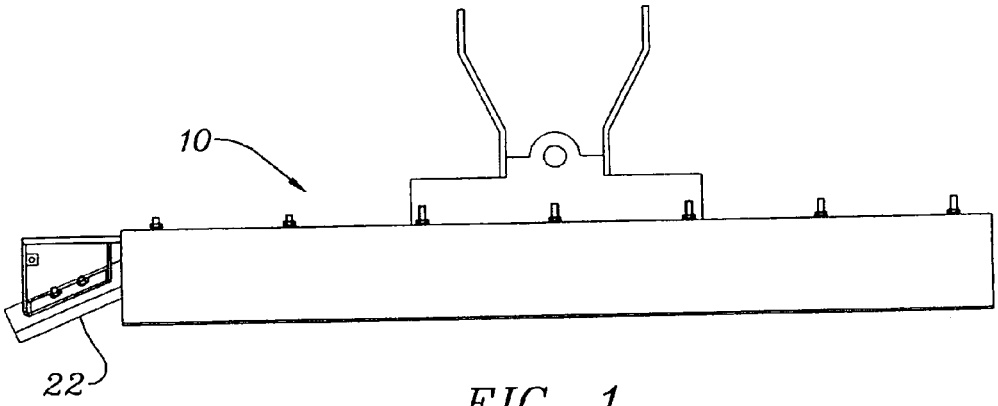
FIG. 1 is a top view of a snowplow including the improvement of this invention.
Figure 2:
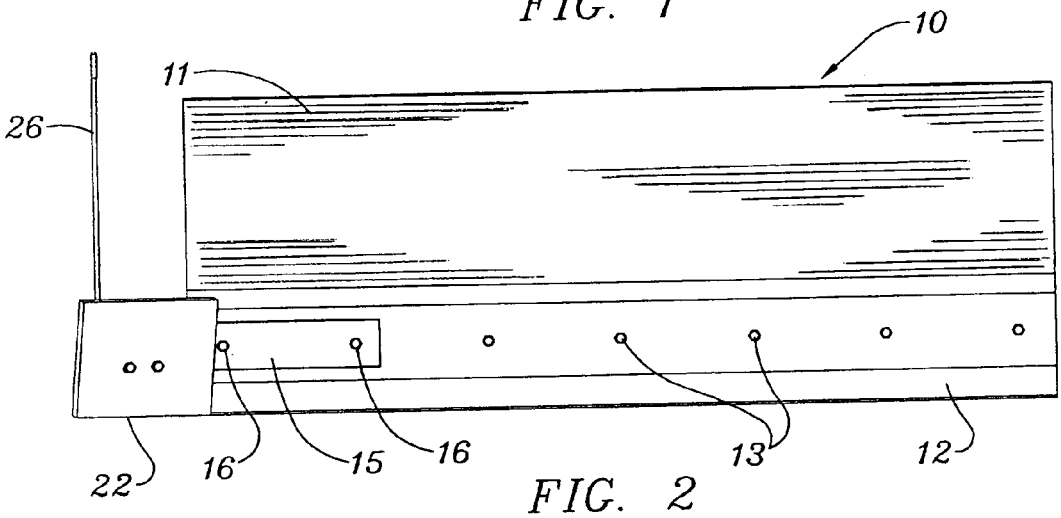
FIG. 2 is a front view of the snowplow of FIG. 1.
Figure 3:
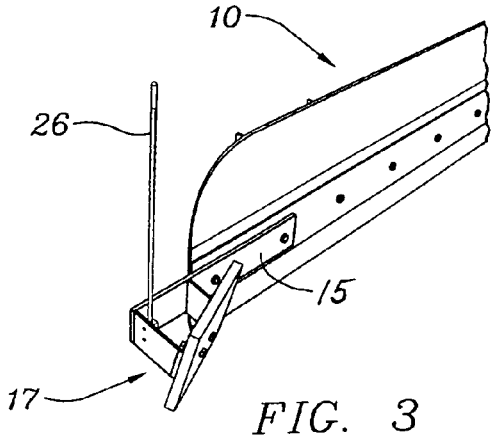
FIGS. 3, 4 are pictorial views of the left portion of FIG. 2
Figure 4:
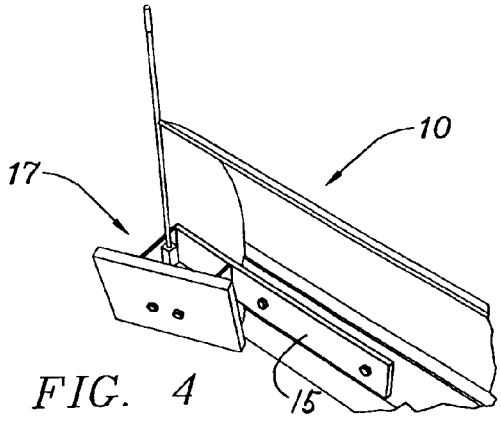

With reference to the drawing, a snowplow 10 includes an upstanding blade 11 with a bottom plate 12 extending the width of the blade 11 and connected to it by bolts 13 at spaced locations along the blade. The blade 11 and bottom plate 12 are straight and rigid from end to end. The plow described thus far is typical of the prior art.

Figure 5:
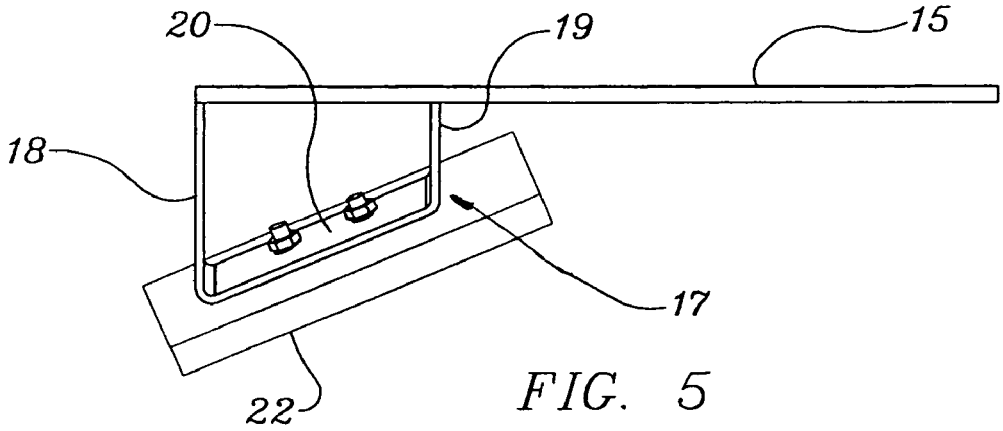
FIG. 5 is an enlarged top view of a detail from FIG. 2.
Figure 6:
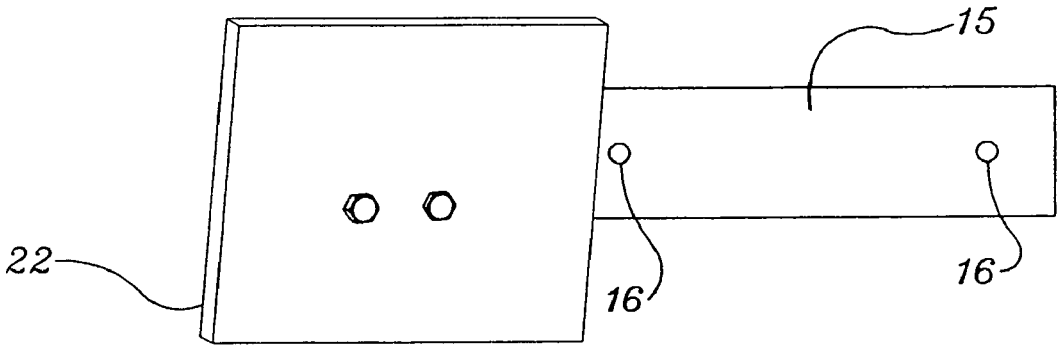
FIG. 6 is a front view of FIG. 5.
Figure 7:
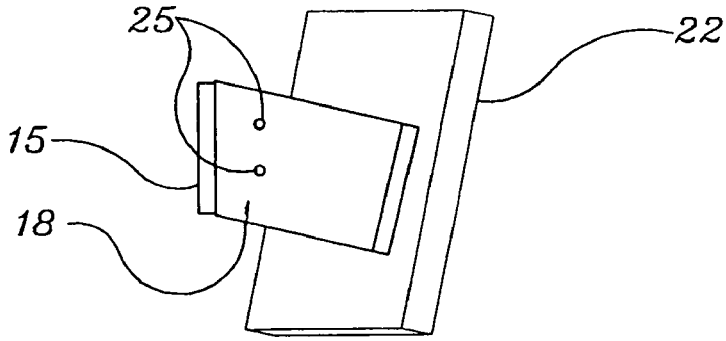
FIG. 7 is a left end view of FIG. 6.

The improvement of this invention includes a flat mounting plate 15 bolted at spaced bolt locations 16 to the left end of the bottom plate 12 of the plow. The mounting plate 15 includes an angled bracket 17 welded or otherwise fixed to it. The bracket 17 is a section of channel (see FIG. 5), including parallel flanges 18, 19 fixed to the mounting plate and extending forward from it, and a web 20 connecting the flanges and spaced forward of the mounting plate to form a substantially planar pad plate. The plane of the pad plate 20 is skewed relative to the plane of the mounting plate 15.

More specifically, the pad plate 20 is inclined inward and downward relative to the vertical plane of the mounting plate 15.

A rectangular rubber pad 22 is bolted to the front of the pad plate 20. The rubber pad 22 is significantly larger in area than the pad plate 20, and extends inward, outward, upward, and downward from the pad plate 20. The rubber pad 22 is resilient, providing the cushioning improvement of this invention.

As an example only, the rubber pad 22 is 10" high, 12" wide, 1" thick. It extends downward approximately two inches below the lower edge of the mounting plate 15.

The rubber pad 22 enables the end of the plow to "give" somewhat, enabling the plow end to scrape curbs, grates, storm drains, and the like without gouging or destroying them, without destroying the blade, and without injury to the driver.

Mounting of the rubber pad 22 is reversible, top to bottom and front to back, to accommodate for wear. The pad 22 is bolt-mounted to the pad plate 20 to facilitate its removal for reversal or replacement, as necessary.

The several bolt locations 13 along the bottom plate 12 permit selective positioning of the mounting plate 15 along the bottom plate 12 to vary the plow width, as desired.

The mounting bracket 17 includes bolt holes 25 through its outside flange 18 for mounting a plow end pole or end indicator 26.

The rubber pad 22 gives the plow a certain configuration (FIGS. 1 and 5) which tends to gather snow into itself instead of pushing it aside.

The foregoing description relates to this invention as shown on the "curb" end of the plow. A similar, symmetrical, arrangement of mounting plate 15, bracket 17, and pad 22, may be mounted on the left end of the plow, if desired and appropriate to the plowing job to be done.

In this specification: "rubber" is intended as a convenient term to include the entire range of rubbers or elastomers suitable for the use described herein; the "curb" end of the plow is the left end in the drawing, the right end as seen by its driver.

Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A snowplow including an upstanding blade (11), a bottom plate (12) extending along the bottom of said blade, said blade and said bottom plate including bolt holes (13) spaced therealong for connection of said bottom plate to said blade, and the improvement including:

an elongated flat mounting plate (15) removably bolted to the front of said bottom plate (12) for selective positioning along said bottom plate (12), said mounting plate (15) including inner and outer ends;

a channel bracket (17) extending forward from the outer end of said mounting plate (15), said channel bracket (17) including a pad plate (20) inclined inward and downward relative to the flat of said mounting plate (15); and a rectangular resilient rubber pad (22) removably mounted on said pad plate (20) and invertible and reversible thereon, said pad (22) overlapping said pad plate (20) laterally and vertically irrespective of inversion or reversion of said pad (22).

2. A snowplow improvement as defined in claim 1, wherein said pad plate (20) is substantially planar, inclined inward and downward relative to said mounting plate (15), whereby said rubber pad (22) is similarly inclined inward and downward, whereby to give said snowplow, in a horizontal plane, a concave configuration.

3. A snowplow improvement as defined in claim 1, wherein said bottom plate (12) includes a plurality of bolt holes (13) spaced therealong for selective positioning of said mounting plate (15) along said bottom plate (12) for variable plow width.

* * * * *